US006267332B1

(12) United States Patent
Almblad

(10) Patent No.: US 6,267,332 B1
(45) Date of Patent: Jul. 31, 2001

(54) RAILROAD SAFETY SYSTEM

(76) Inventor: Robert E. Almblad, 440 Banbury Rd., Mundelein, IL (US) 60060

( * ) Notice: Subject to any disclaimer, the term of this patent is extended or adjusted under 35 U.S.C. 154(b) by 0 days.

(21) Appl. No.: 09/479,084

(22) Filed: Jan. 7, 2000

(51) Int. Cl.[7] ..... B61L 29/04

(52) U.S. Cl. ..... 246/294; 246/292; 246/293; 246/295; 246/296

(58) Field of Search ..... 246/124, 270 R, 246/167 R, 292, 120, 121, 125, 127, 293, 294, 295, 296

(56) References Cited

U.S. PATENT DOCUMENTS

| | | | | |
|---|---|---|---|---|
| 1,755,050 | | 4/1930 | Canut et al. . | |
| 1,768,640 | | 7/1930 | Sommer . | |
| 1,787,674 | | 1/1931 | Estevez et al. . | |
| 1,798,302 | | 3/1931 | Bouthors . | |
| 2,228,909 | | 1/1941 | Glowka . | |
| 4,073,453 | | 2/1978 | Thomas . | |
| 4,666,108 | * | 5/1987 | Fox | 246/125 |
| 4,703,303 | * | 10/1987 | Snee | 340/47 |
| 4,782,628 | * | 11/1988 | Gaddis | 49/340 |
| 4,942,395 | * | 7/1990 | Ferrari et al. | 340/907 |
| 5,620,155 | | 4/1997 | Michalek . | |
| 5,699,986 | | 12/1997 | Welk . | |
| 5,724,020 | * | 3/1998 | Hsu | 340/286.05 |
| 5,735,491 | * | 4/1998 | Atkinson | 246/124 |
| 5,735,492 | | 4/1998 | Pace . | |
| 5,786,768 | | 7/1998 | Chan et al. . | |
| 5,805,059 | | 9/1998 | Tea . | |
| 5,864,304 | * | 1/1999 | Gerszberg et al. | 340/903 |
| 5,890,682 | * | 4/1999 | Welk | 246/125 |
| 5,924,651 | * | 7/1999 | Penza et al. | 246/124 |
| 5,954,299 | * | 9/1999 | Pace | 246/293 |
| 6,020,815 | * | 2/2000 | Eslambolchi et al. | 340/539 |

* cited by examiner

*Primary Examiner*—S. Joseph Morano
*Assistant Examiner*—Frantz F. Jules
(74) *Attorney, Agent, or Firm*—Michael R. McKenna

(57) ABSTRACT

A railroad safety system for use at an intersection of a roadway and a railroad track, that comprises a sensor for detecting a hazardous situation and a voice alarm for giving a voice command to warm drivers and pedestrians of the hazardous situation.

2 Claims, 3 Drawing Sheets

RAILROAD SAFETY SYSTEM

BACKGROUND OF THE INVENTION

This invention relates to a railroad safety system for use at an intersection of a roadway and a railroad track, that comprises a voice alarm that is operably connected to either an existing intersection signal/gate system to warn that a train is approaching the intersection or an object sensor located proximate the intersection sensing that vehicles or pedestrians are at or near the intersection. The voice alarm is actuated to warn those individuals immediate to the railroad crossing intersection of an existing safety hazzard.

There are two main problems at Railroad crossings: 1) people get trapped on the tracks by traffic, or have too long a vehicle and are unaware their back end is on the tracks, and 2) they drive onto tracks thinking no train is coming.

One solution to first problem is trying to keep traffic control lights as far away as possible from any Railroad crossing so when the traffic is backed up, that it does not reach the Railroad crossing. Another solution is trying to "time" gates with traffic control lights, so traffic moves freely before the train arrives. These solutions are sometimes impossible and have become more and more difficult to implement in urban areas because increased traffic and urban sprawl with more streets and building have created a situation where there is not enough driveway area to allow for cars to be temporarily placed out of harms way between a Railroad crossing and a traffic light. There is so much traffic, that no "storage" area is enough and timed lights don't help with grid lock at rush hours in most large towns and cities. Consequently, cars get trapped on the tracks more and more often.

The solutions to the second problem has varied around the world, but in the US they mainly consists of a 2 quadrant gate coming down 30 seconds before the train arrives, while at the same time the train is blowing the horn 1,000 feet before the intersection. The train horn blowing has caused "noise pollution" keeping adjacent homeowners awake at night with incessant train horns. It has also prevented many vehicles from driving around the gates trying to "beat the train". The loud whistle is an effective deterrent.

To eliminate the need for a train horn, a 4 quadrant gate system has been installed, which has worked well. But, it is expensive, costing over $100,000 per railroad intersection, which is more than most towns can afford. Consequently, only a few of these 4 quadrant gates have been installed. While the railroad safety system of this invention can readily be adapted for the 4 quadrant gate system, it preferred use is with the 2 quadrant system.

In general, this new extensible arm segment may be composed of existing, mature technology that is being adapted for use with railroad crossings. The new gate system itself can be adapted to high speed rail without any modification other than the "swap out" replacement of the old gate arm with the new extensible gate arm.

Train horns are supposed to sound at 1,000 feet before all Railroad crossings by Federal regulation. This regulation began in 1991 and it has caused a fire storm of political controversy because millions of homes all across the US are being annoyed to no end by these horns. Millions of people are screaming to their mayors, governors, etc. By regulation, these horns are so loud that a motorist can hear them with the windows rolled up and the radio blasting away. So, home owners are awoken at night and normal conversations are interrupted sometimes 30 to 50 times a day. So, people are up in arms.

A wayside horn is a known technology and has been tested and sold since about 1995. It was invented about 5–10 years ago. It has been used to try to substitute for real train horns in an effort to make less noise pollution in towns. One of the drawbacks to the wayside horn is that when the gates go down and the wayside horn is activated, it can be that the horn is on too long and then motorists learn that no train is coming for 30 seconds (30 seconds is the regulated time between gates going down and the arrival of a train) and so they learn they can drive around the gates even if the wayside horn is sounding. In other words, the train is not sounding its horn just before it arrives.

The townspeople effected by noise pollution want this wayside horn badly because it reduces noise pollution by 90% and it is a cheap alternative to closing the alternative to closing the intersection or putting up a 4 quadrant gate. But the concern of the FAR (Federal Railroad Administration) is that if Railroad crossing safety is compromised, like the Florida ban, then the wayside horn should not be used as a substitute.

Historically, gates are used to stop vehicular traffic at Railroad crossings. The most common gate is a 2 quadrant gate. However, it fails to work when either a long vehicle unknowingly has their back end sticking out on the tracks or a car gets blocked on the tracks by vehicles stopped in front.

In the long vehicle case, the driver can only be informed by voice alarm what to do. That is, "pull forward", or a comparable voice command. In the blocked vehicle case, the forward drivers can only be warned that they are blocking traffic behind them.

The bells at the gate and train horn do not warn these drivers because these sound at all Railroad crossings. The gates do not help because they are behind the driver(s). So, the drivers in these two types of cases (long vehicle drivers, and drivers in front of vehicles blocked on the tracks) remain ignorant of the danger. Of the 400 deaths each year at Railroad crossings, many are caused by this ignorance. With the proper warning, these accidents could be prevented.

These deaths occur mostly because 1) they are impatient and try to drive around the gates or 2) for some reason they just stop on the tracks. The current invention handles these two scenarios.

1) Impatient Driver Scenario. Railroad gates swing down about 20 seconds before a train comes by. To prevent an impatient motorist from trying to drive around Railroad gates, either within this 20 seconds or just after a train passes and encountering a second train, I proposed that a motor driven extensible arm be extended across the opposite lane a couple seconds after the gate swings down. This few second delay allows traffic in the opposite direction to clear the tracks and not get trapped between the gates. Thus, the extended arm, with attendant strobe lights, physically prevents impatient drivers going around the gates.

2) Stopped on Tracks Scenario. For motorists stuck or stopped on the tracks, the proximity detector (i.e. car sensor) detects their presence and immediately retracts the arm while issuing very loud voice instructions to get off the tracks. This clear and continuous stream of commanding instructions are enunciated to get the person off the tracks who might be sitting there because they are a) blocked by forward traffic; b) frozen in fear by all the commotion and therefore need the command instructions, or c) they are a long vehicle like a school bus, and do not realize the train while is actually meant for them, because their back end is handing over the tracks.

To alleviate this problem, and others which will become apparent from the disclosure which follows, the present invention conveniently uses a voice command to free up congested traffic at a railroad crossing, to reduce noise pollution with a wayside horn and voice command alarm is proposed in place of the train horn.

The system's preferred operation is as follows. When the gate arm swings down to approximately 5 degrees of horizontal, a mercury switch is activated and 2–3 seconds later an extensible arm segment is extended across the entire opposite lane of traffic, preventing vehicles from driving around the gates. Additionally, strobe lights imbedded in the extensible arm segment begin flashing toward any possible intruders. If a vehicle or person has not cleared the tracks after the extensible arm segments have come down and the 2 seconds interval has passed, then gate arm sensors ("car sensors") detect this obstruction and issue a loud voice command to "get off the tracks" through a public address ("PA") system equipped with a digital playback device. When the obstruction has cleared the tracks, the extensible arm segment is extended and remains that way until another intruder is detected or the gate is raised. When the gate is raised, the extensible arm segment is quickly retracted by spring action, allowing the gate to be raised while the extensible arm segment is in a fully retracted position. This new, inexpensive extensible arm segment may easily be retrofitted to any existing 2 quadrant gate to create a "sealed corridor" for safe high-speed train service. And, with the car sensor detection and a voice alarm system it can alert the blocking driver or the driver of a long vehicle that the rear of his vehicle is on the tracks and prevent tragedies like Fox River Grove, Ill., bus accident.

The retrofitted gate arm is about the same weight as a regular gate arm and is constructed of a higher grade aluminum and other light weight materials that partially compensate for the extra weight added by the full length extensible arm segment, drive motor, PA system and various electronic parts.

A mercury switch, or its equivalent, is activated when gate arm is approximately 5 degrees of the fully down position. The gate extension mechanism should preferably operate in this position (0 to 5 degrees). After the gate is down and arm segment is extended, the extensible arm segment will retract automatically only when gate is raised higher than approximately 5 degrees or it is actuated by the sensor. In case of failure, spring loaded arm segment will retract automatically. Raising gate 5 degrees by hand, will also cause the arm to retract.

After gate is down and a predetermined time interval (preferably 2 seconds) has passed, the extensible arm segment will extend to expose the vehicle detection sensor. If an obstruction is detected, the extension discontinues and the PA system announces in loud voice commands to clear the tracks. This is particularly important to drivers of long vehicles that are unaware the back end of the vehicle is on the Railroad tracks or drivers of vehicles unknowingly obstructing traffic behind them. While these drivers can easily ignore a train horn, because all crossing require train horns, they can not ignore a PA system warning that his truck is still on the tracks or that he or someone is obstructing other vehicles from clearing the tracks. With proper warning, people can save their own lives and aware drivers can save the lives of others.

If no obstructions are detected, the extensible arm segment is fully extended into opposite traffic lane with strobes flashing on one side and the vehicle sensor activated and "looking" for trapped vehicles or pedestrians on the other side. Detection of any obstructions will activate the PA system and quickly retract the extensible arm segment (by spring action) to allow a trapped vehicle to escape. If no vehicle is detected for a predetermined period of time (preferably 15 seconds), the sensor will deactivate allowing the train(s) to pass without activating the vehicle detection sensor. The extensible arm segment will remain extended until after the train(s) pass and the gate is raised.

This new gate system will allow high-speed passenger rail service providers to quickly and inexpensively upgrade their 2 quadrant gate crossings to fully guarded gate systems, making each crossing far safer regardless of train speed.

This is a very versatile system because we can observe how it operates and then modify the voice alarm with specific commands to fit the situations that arise and provide improved voice messages as experience dictates.

In any case, it is the hope and belief of the applicant that this gate will be made applicable at all 2 quadrant gate railroad crossings where it will save lives because it guards where now there is only a warning and it warns where now there is only ignorance.

ADVANTAGES OF THIS INVENTION

What we are doing here is adding our "voice commander" to the wayside horn. This would do two things: 1) increase the safety at a railroad crossing (because of our vehicle detector and resultant voice commands to "get off the tracks") while, 2) at the same time reducing noise pollution with a wayside horn. The product of this invention would result in greater safety and less noise pollution.

This railroad safety system includes a sensor that detects a vehicle by means of a non-contact signal like radar, infrared or microwave. These are used to detect people, like a grocery store door or a vehicle at an automatic exit gate in a parking lot. There are many types of sensors. But these three are easily usable in the present system. The warning issued would be something like: "Pull forward. You are blocking someone on the tracks. Danger! Danger!"

Also, a mercury level sensor can be placed on thee gate itself, so if the gate does not go down, or goes down only partially, then an appropriate voice command can be issued like "Someone is blocking the gate. Clear the tracks. The train can not stop.", or "Warning the train is coming but the gate is broken and will not come down."

Lastly, our system can do one more thing, when the gates are down and no vehicle is detected, but then some time interval later, preferably about 10 seconds, if a vehicle is detected in the opposite lane, the railroad safety system can issue a voice command "Stop! Danger! Train is Coming!" or some like command. As this is a person that is "creeping up" in the opposite lane trying to decide if he should drive around or not . The voice command may be enough to scare him back.

Still other advantages will be apparent from the disclosure that follows.

SUMMARY OF THE INVENTION

The invention relates to a railroad safety system for use at an intersection of a roadway and a railroad track, that comprises means for actuating a voice alarm having a voice alarm. The means for actuating is operably connected to a means for detecting a hazardous situation.

The means for detecting may comprise one of more of the following: means for generating a signal combined with means for sensing the signal that is accessible through the air to and operably responsive to the signal to detect the presence of a vehicle proximate to the intersection for a predetermined period of time, i.e. a car sensor, and means for remotely sensing a train approaching the intersection.

The means for generating and sensing a signal may be part of an existing railroad crossing system, may be add-ons to an existing system, or may be elements of a new railroad crossing system as contemplated by the railroad safety system of this invention. Moreover, the means for remotely sensing a train approaching the intersection may likewise be part of an existing railroad crossing system, may be add-ons to an existing system, or may be non-contact elements of a new railroad crossing system as contemplated by the railroad safety system of this invention.

In operation, upon detecting one of the presence of a vehicle proximate to the intersection for a predetermined period of time and a train approaching the intersection, the voice alarm is actuated to warn any one or more drivers of vehicles immediate to the intersection, including any driver of a vehicle proximate to the intersection, of an existing safety hazzard.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Preferred embodiments of the invention are described hereinafter with reference to the accompanying drawing wherein.

DETAILED DESCRIPTION OF THE INVENTION

Figure 1:
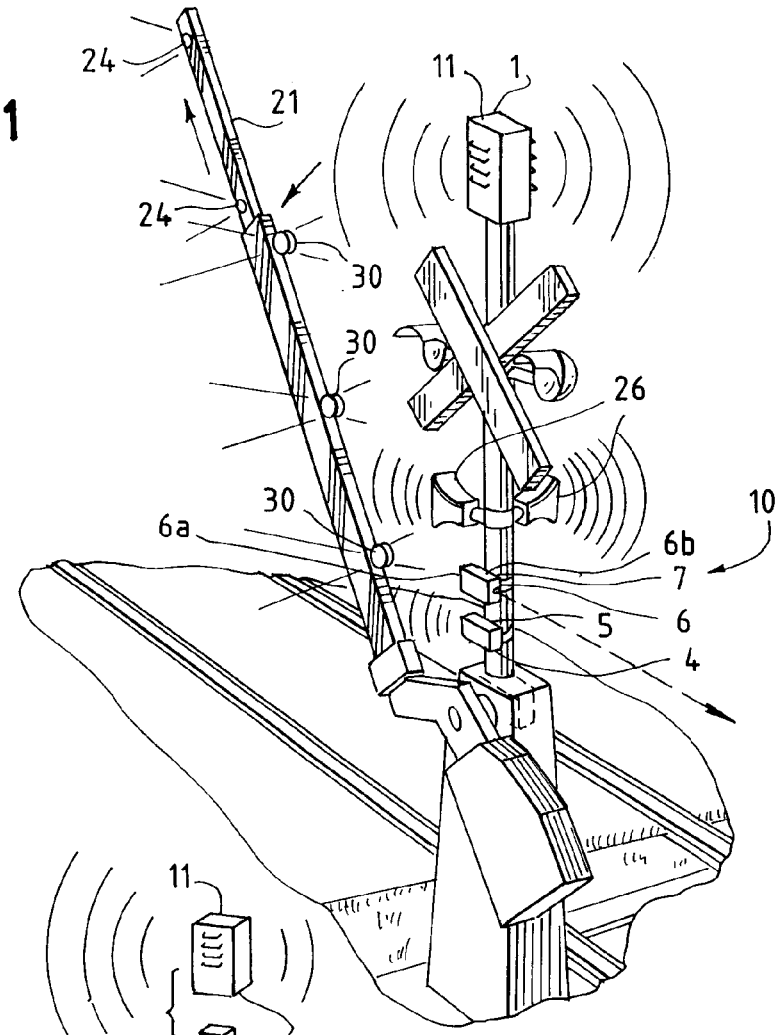
FIG. 1 is a perspective view of a railroad safety system of the present invention showing a car sensor for determining the presence of a pedestrian or vehicle, a non-contact remote train sensor for determining that a train is approaching, an extensible arm of the crossing gate for preventing vehicles from circumventing the lowered gate in their lane, a voice alarm to warn vehicles and pedestrians alike to "clear the tracks", or provide alternative voice commands to facilitate safety, and the wayside horn to be used in lieu of or in addition to the train horn.
Figure 2:
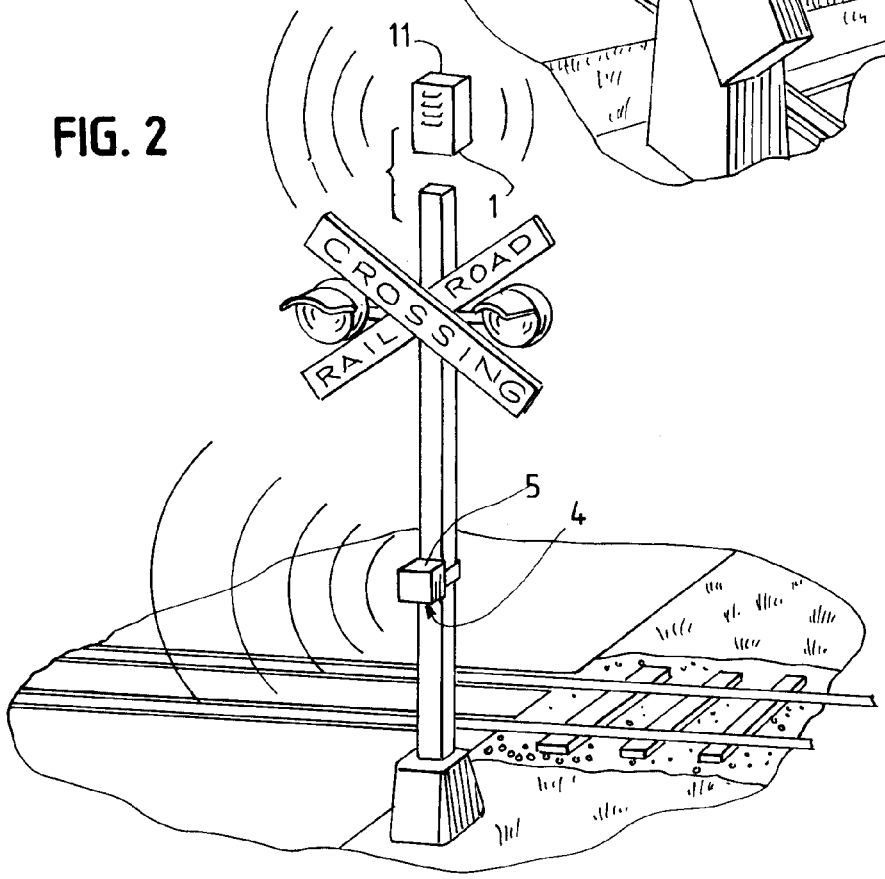
FIG. 2 is a perspective view of the road crossing without a gate which provides for a car sensor and a voice alarm of the instant invention.

The preferred embodiments depicted in the drawing comprise a railroad safety system for use at an intersection of a roadway and a railroad track, that comprises means for actuating a voice alarm having a voice alarm. The means for actuating is operably connected to either a warning system of the intersection signal/gate system that a train is approaching the intersection or a sensor sensing that vehicles are on or near the intersection. The voice alarm is actuated to warn any one or more drivers of vehicles immediate to the intersection of an existing safety hazzard.

Without departing from the generality of the invention disclosed herein and without limiting the scope of the invention, the discussion that follows, will refer to the invention as depicted in the drawing.

The preferred embodiments of the apparatus depicted in the drawing comprise a railroad safety system 10 for use at an intersection of a roadway and a railroad track is disclosed herein comprising means for actuating 2 a voice alarm having a voice alarm 1, means for generating a signal 4, and means for sensing 5 the signal that is accessible through the air to and operably responsive to the signal to detect the presence of a vehicle proximate to the intersection for a predetermined period of time. The means for sensing 5 is operably connected to the means for actuating 2 a voice alarm 1. So that upon sensing the presence of a vehicle proximate to the intersection for a predetermined period of time the voice alarm is actuated to warn any one or more drivers of vehicles close to the intersection, including the driver of the vehicle proximate to the intersection, of an existing safety hazzard.

The foregoing safety system can detect pedestrians as well as vehicles. The means for generating 4 and means for sensing 5 may comprise a sensor 3 that is preferably a transceiver, but can also include a distinct signal generator and a distinct signal receiver, respectively.

In a preferred embodiment of the railroad safety system 10 of the present invention, the voice alarm 1 comprises a public announcement system 11 with at least one prerecorded voice message.

Another embodiment of the railroad safety system for use at an intersection of a roadway and a railroad track comprises means for actuating 2 a voice alarm having a voice alarm 1 and means for remotely sensing 6 a train approaching the intersection. The means for remotely sensing 6 is operably connected to the means for actuating 2 a voice alarm, so that upon sensing the presence of a train approaching the intersection, a voice alarm 1 is actuated to warn any drivers of vehicles in or approaching the intersection of an existing safety hazzard. The means for actuating 2 a voice alarm 1 may include a raw or processed signal from a car sensor 3*a*, a non-contact laser (train) sensor 7, and means for determining 8 a lowered gate arm position.

In another embodiment of the railroad safety system, means for actuating 2 a voice alarm having a voice alarm 1 is joined with means for detecting a hazardous situation.

The means for detecting a hazardous situation comprises one of means for generating 4 a signal combined with means for sensing 5 the signal that is accessible to and operably responsive to the signal to detect the presence of a vehicle proximate to the intersection for a predetermined period of time, and means for remotely sensing 6 a train approaching the intersection. The means for detecting is operably connected to the means for actuating 2 a voice alarm. Upon detecting one of the presence of a vehicle proximate to the intersection for a predetermined period of time and a train approaching the intersection, the voice alarm 1 is actuated to warn any one or more drivers of vehicles immediate to the intersection, including any driver of a vehicle proximate to the intersection, of an existing safety hazzard.

Preferably, the means for remotely sensing 6 a train approaching the intersection comprises a non-contact laser sensor 7.

In another embodiment of the railroad safety system 10 for use at an intersection of a roadway and a railroad track, means for actuating 2 a voice alarm having a voice alarm 1 are provided with means for remotely sensing 6 a train approaching the intersection. The means for remotely sensing is operably connected to the means for actuating 2 a voice alarm 1, in such a way that upon sensing the presence of a train approaching the intersection, the voice alarm 1 is actuated to warn any drivers of vehicles approaching the intersection of an existing safety hazzard.

Figure 7:
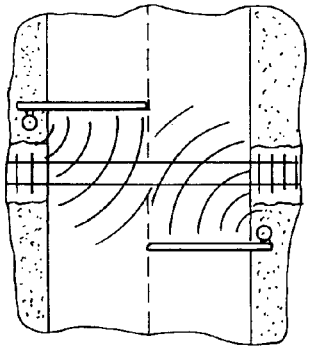
FIG. 7 is a top plan view of the railroad crossing intersection with the car sensor signals emanating from the vertical gate post.
Figure 8:
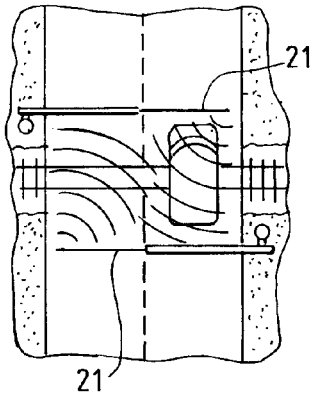
FIG. 8 is a top plan view of the railroad crossing intersection showing the two quadrant gate system with extensible means that traps a vehicle between said gates and showing the car sensor signals emanating from the extended gates which determines the presence of the trapped vehicle.
Figure 9:
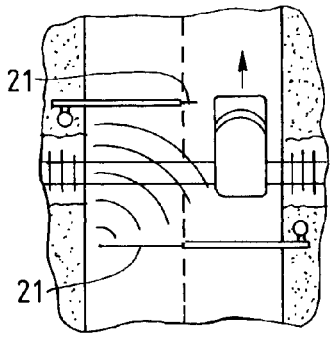
FIG. 9 is a top plan view of the railroad crossing intersection shown in FIG. 8 with the extensible arm withdrawn upward gate in response to the car sensor permitting the vehicle to move forward and clear the tracks.
Figure 10:
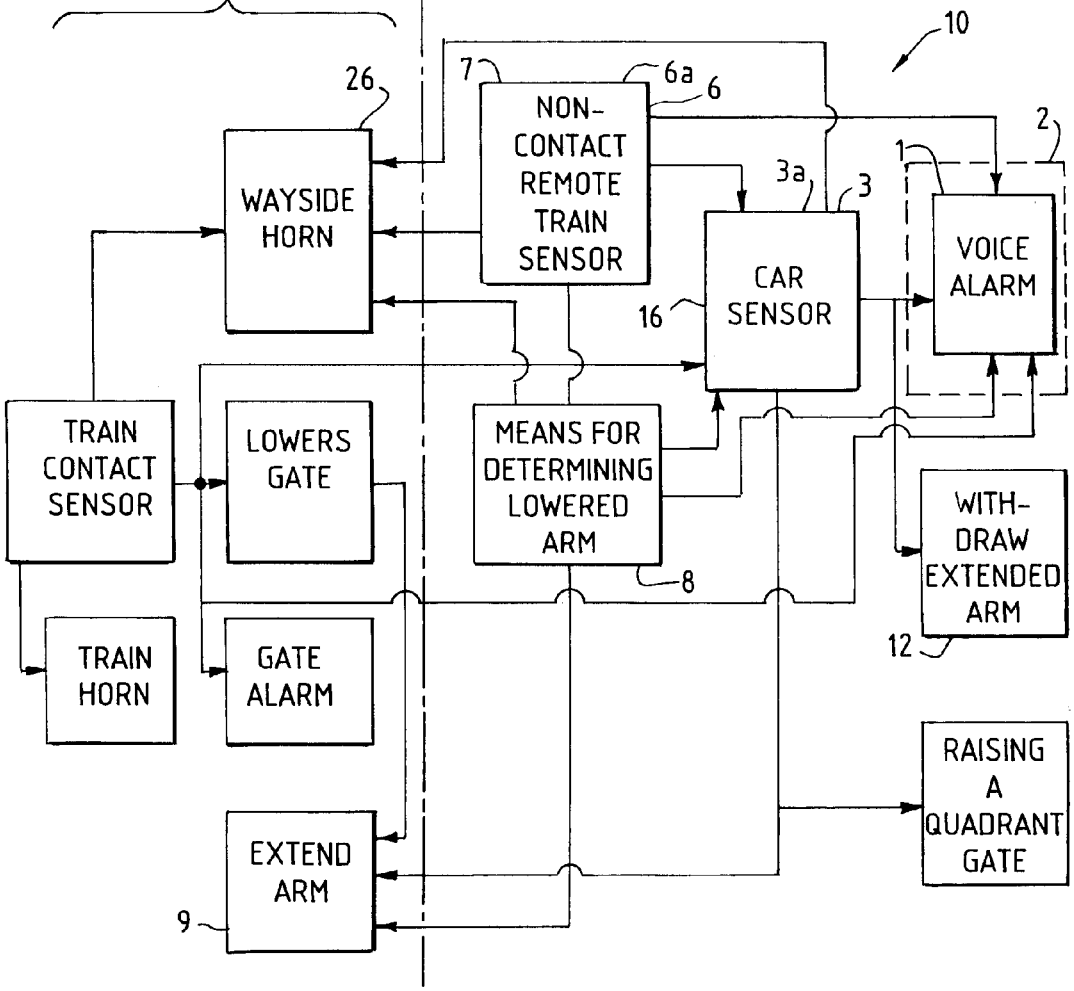
PRIOR ART FIG. 10
FIG. 10 is a schematic diagram of the various components of the railroad safety system as they interrelate to each other and to the existing prior art components.

Another embodiment of the railroad safety system 10 is for use at an intersection of a roadway and a railroad track having a two quadrant gate system with two gates, as best shown in FIGS. 7–9, each of which when lowered restricts traffic in one of the two directions of the roadway. It comprises means for actuating 2 a voice alarm having a voice alarm 1, means for generating 4 a signal for each quadrant, and means for sensing 5 the signal for each quadrant that is accessible to and operably responsive to the signal for each quadrant to detect the presence of a vehicle proximate to the intersection.

The means for sensing 5 is operably connected to the means for actuating 2 a voice alarm, as best illustrated by the connection between the car sensor 3*a* and said means. Upon sensing the presence of a vehicle proximate to the intersection the voice alarm is actuated to warn any one or more drivers of vehicles immediate to the intersection, including the driver of the vehicle proximate to the intersection, of an existing safety hazzard.

In a preferred embodiment of this railroad safety system, the means for sensing 5 the signal for each quadrant is operably connected to the two quadrant gate system (see particularly FIGS. 3–5), and upon sensing the presence of a vehicle proximate to the intersection at least one of the gates restricting traffic is raised to afford the driver of the vehicle proximate to the intersection a way of escaping an existing safety hazzard.

Figure 4:
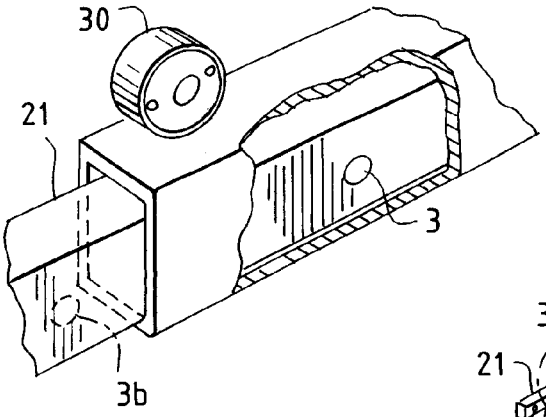
FIG. 4 is an enlarged perspective view of the circled section of FIG. 3, showing the car sensor on the extensible arm protected inside the permanent arm when the extensible arm is retracted.
Figure 3:
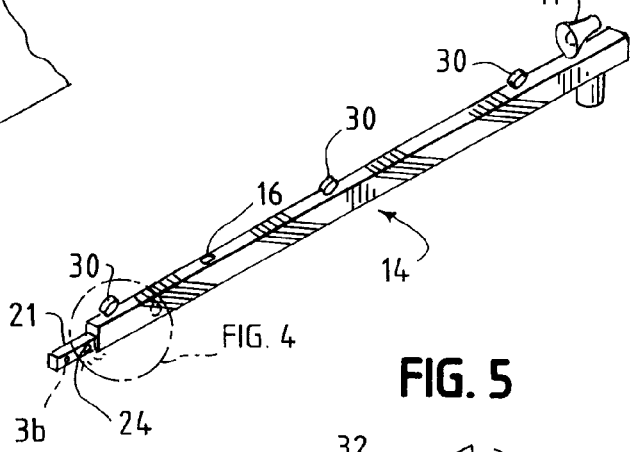
FIG. 3 is a perspective view of a replacement gate arm with a telescoping extensible arm segment, the extensible arm having a car sensor. Both the gate arms provide warning lights and the base of the permanent arm provides a voice alarm and a mercury switch to determine when the gate is in a lowered position.
Figure 5:
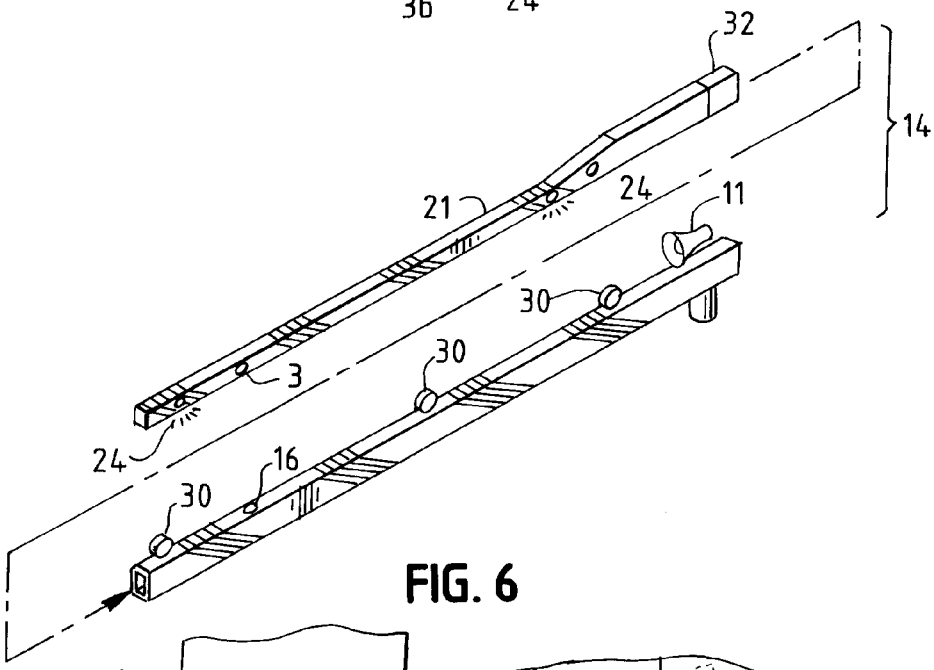
FIG. 5 is an exploded perspective view of the gate arm with the extensible segment removed from the permanent arm.

Preferably, the means for sensing 5 the signal for each quadrant comprises a sensor 3 for each quadrant, as illustrated in FIG. 8, each of which sensor is operably connected to one of the gates of the two quadrant gate system, as shown in FIGS. 3–5. Thus, when one of the sensors 3 senses the presence of a vehicle proximate to the intersection in one of the two quadrants, the gate associated with that sensor is raised to afford the driver of the vehicle proximate to the intersection a way of escaping an existing safety hazzard.

Additionally, means for determining 8 that the gates are being disposed in a lowered position that is operably connected to the means for generating 4 a signal for each quadrant may be provided to initiate the means for generating 4 a signal when the gates are being disposed in a lowered position.

Moreover, as shown in FIG. 8, each gate of the two quadrant gate system may have means for extending 9 its length so that each gate can restrict traffic for each of the two directions of the roadway. Such means for extending 9 is operably connected to the means for determining 8 and to the means for sensing 5, so that the means for determining 8 actuates the means for extending 9 so that each gate can restrict traffic for each of the two directions of the roadway. Upon sensing the presence of a vehicle proximate to the intersection that is trapped between the gates, the means for sensing 5 can de-activate the means for extending, actuating means for withdrawing 12 the extended arm 21 on at least one gate associated with the quadrant in which the vehicle was sensed to allow the vehicle trapped between the gates a way of escaping an existing safety hazzard. See FIGS. 8 and 9 for an illustration of the arm in an extended and withdrawn positions.

In another preferred embodiment of the railroad safety system of this important invention, the means for sensing 5 has a path sensor 3*b* associated with each gate of the two quadrant gate system. Each path sensor is accessible and operably responsive to the signal to detect the presence of an object in a path of the gate, to which it is associated, as extended, as the gate travels from a generally vertical upward position to a generally horizontal downward position. The means for extending 9 is operably connected to the means for sensing 5, so that upon sensing the presence of an object in a path through which the gate as extended travels, the means for sensing 5 de-activates the means for extending the extendible arm 21 of the gate, thereby, preventing possible injury to the object and the gate.

Referring to FIGS. 1 and 3–5, a preferred embodiment of the railroad safety system of the present invention is shown with the means for extending 9 the length of the gate comprising a telescoping arm 21 disposed in the gate and an associated drive motor 32. The means for determining comprises a level switch 16 disposed in the gate, and the means for sensing 5 the presence of a vehicle is disposed in the telescoping arm 21. As shown in FIG. 5, the means for actuating 2 a voice alarm having a voice alarm comprises a public address system 11 disposed on the gate. In this structure, the railroad safety system can be disposed on the respective gates of the two quadrant gate system, where replacement gates 14 can be used to upgrade existing two quadrant gate systems to include the elements and function of the instant invention.

Moreover, strobe lights 24 may be employed on the gates to enhance recognition of the warning and safety systems taught by the present invention, and in addition to the standard red warning lights 30 which flash intermittently.

Figure 6:
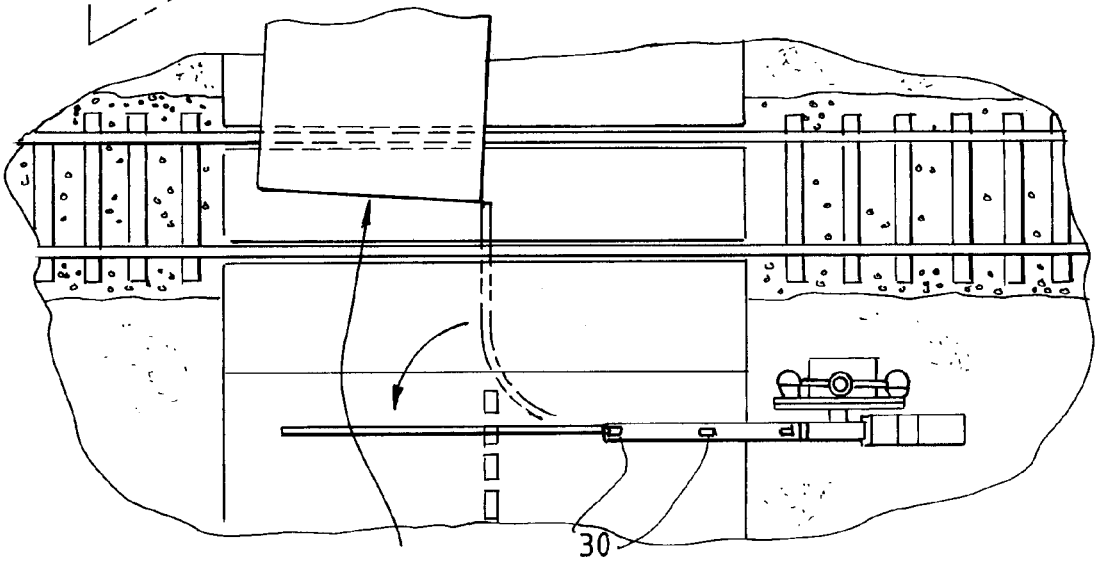
FIG. 6 is a top plan view showing the two quadrant gate with a flexible gate arm disposed thereon.

Each gate of the two quadrant gate system may alternatively be laterally flexible, as shown in FIG. 6, to allow a vehicle to pass through a lowered gate as a way of escaping an existing safety hazzard without breaking the gate or damaging the vehicle.

Preferably, the voice alarm 1 comprises a public announcement system 11 with at least one pre-recorded voice message. The public announcement system preferably comprises a digital playback device.

Another preferred feature of the railroad safety system 10 of this important invention includes a wayside horn 26 that is operably connected to the means for determining 8. When it determines that the gates are being disposed in a lowered position the wayside horn 26 is actuated to warn any one or more drivers of vehicles immediate to the intersection of an existing safety hazzard.

Another preferred embodiment features a non-contact means for remotely sensing 6*a* a train approaching the intersection with a wayside horn 26 that is operably connected to the non-contact means for remotely sensing 6*a*. Upon remotely sensing that a train is approaching the intersection the wayside horn is actuated to warn any drivers of vehicles approaching the intersection of an existing safety hazzard.

Preferably, the non-contact means for remotely sensing 6*a* a train approaching the intersection comprises a laser sensor 7.

Another preferred embodiment of the railroad safety system, for use at an intersection of a roadway and a railroad track having a two quadrant gate system with two gates, each of which when lowered restricts traffic in one of the two directions of the roadway, comprises means for actuating 2 a voice alarm having a voice alarm 1, means for generating 4 a signal for each quadrant, and means for initiating.

The means for initiating comprises at least one of means for determining 8 that the gates are being disposed in a lowered position and means for remotely sensing 6 a train approaching the intersection. The means for initiating is operably connected to the means for generating 4 a signal for each quadrant.

Also included is a means for sensing 5 the signal for each quadrant that is accessible to and operably responsive to the signal for each quadrant to detect the presence of a vehicle proximate to the intersection. The means for sensing 5 is operably connected to at least one of the means for actuating 2 a voice alarm and the two quadrant gate system.

Another element of this preferred embodiment is a wayside horn 26 that is operably connected to the means for initiating.

In operation, when at least one of the gates is disposed in a lowered position and a remote sensing that a train is approaching the intersection occurs, at least one of a) the wayside horn 26 to warn any one or more drivers of vehicles immediate to the intersection of an existing safety hazzard is actuated, and b) a signal which can be sensed to indicate the presence of a vehicle proximate to the intersection is generated, whereupon sensing the presence of a vehicle proximate to the intersection, a voice alarm is actuated to warn any one or more drivers of vehicles immediate to the intersection, including the driver of the vehicle proximate to the intersection, of an existing safety hazzard.

Another preferred embodiment of the railroad safety system of the present invention, for use at an intersection of a roadway and a railroad track having a gate system with one of more gates including means for ascertaining 28 that a train is approaching the intersection (i.e. train contact sensors or other remote train sensors), with each of the gates when lowered restricting traffic in the roadway, comprises means for actuating 2 a voice alarm having a voice alarm 1. The means for actuating 2 is operably connected to the means for ascertaining 28, so that when the gate system ascertains that a train is approaching the intersection, the voice alarm 1 is actuated to warn any one or more drivers of vehicles immediate to the intersection of an existing safety hazzard.

A final preferred embodiment of the railroad safety system of the invention disclosed herein, for use at an intersection of a roadway and a railroad track, that has a signal system including means for ascertaining 28 that a train is approaching the intersection, comprises means for actuating 2 a voice alarm having a voice alarm 1. The means for actuating 2 is operably connected to the means for ascertaining 28, so that when the signal system ascertains that a train is approaching the intersection, the voice alarm is actuated to warn any one or more drivers of vehicles immediate to the intersection of an existing safety hazzard.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

My invention resides not in any one of these features per se, but rather in the particular combination of all of them herein disclosed and claimed and it is distinguished from the prior art in this particular combination of all of its structures for the function specified.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

What is claimed as being new and desired to be protected by Letters Patent of the United States is a follows:

1. A railroad safety system, for use at an intersection of a roadway and a railroad track having a two quadrant gate system with two gates, each of which when lowered restricts traffic in one of the two directions of the roadway, comprising:

means for actuating having a voice alarm;

means for generating a signal for each quadrant; and means for sensing the signal for each quadrant that is accessible to and operably responsive to the signal for each quadrant to detect the presence of at least one vehicle proximate to the intersection, said means for sensing being operably connected to the means for actuating;

means for determining that the gates are being disposed in a lowered position, said means for determining being operably connected to the means for generating a signal for each quadrant, wherein each gate of the two quadrant gate system has means for extending its length so that each gate can restrict traffic for each of the two directions of the roadway, said means for extending being operably connected to the means for determining, and said means for extending further being operably connected to the means for sensing, said means for extending the length of the gate comprises a telescoping arm disposed in the gate and an associated drive motor, said means for determining comprises a level switch disposed in said gate, said means for sensing the presence of the at least one vehicle is disposed in said telescoping arm, and the means for actuating having a voice alarm comprises a public address system disposed on the gate, whereby, the railroad safety system can be disposed on the respective gates of the two quadrant gate system, the means for determining initiates the means for generating a signal when the gates are being disposed in a lowered position and upon sensing the presence of the at least one vehicle proximate to the intersection the voice alarm is actuated to warn any one or more drivers of the at least one vehicle immediate to the intersection, including the driver of the at least one vehicle proximate to the intersection, of an existing safety hazzard, and the means for determining actuates the means for extending so that each gate can restrict traffic for each of the two directions of the roadway, and upon sensing the presence of a vehicle proximate to the intersection that is trapped between said gates, the means for sensing de-activates the means for extending on at least one gate associated with the quadrant in which the vehicle was sensed to allow the vehicle trapped between the gates a way of escaping an existing safety hazzard.

2. A railroad safety system, for use at an intersection of a roadway and a railroad track having a two quadrant gate system with two gates, each of which when lowered restricts traffic in one of the two directions of the roadway, comprising:

means for actuating having a voice alarm;

means for generating a signal for each quadrant; and means for sensing the signal for each quadrant that is accessible to and operably responsive to the signal for each quadrant to detect the presence of at least one vehicle proximate to the intersection, said means for sensing being operably connected to the means for actuating; and wherein each gate of the two quadrant gate system is laterally flexible to allow the at least one vehicle to pass through a lowered gate as a way of escaping an existing safety hazzard without breaking the gate or damaging the vehicle, whereby, upon sensing the presence of the at least one vehicle proximate to the intersection the voice alarm is actuated to warn any one or more drivers of the at least one vehicle immediate to the intersection, including the driver of the at least one vehicle proximate to the intersection, of an existing safety hazzard.

* * * * *